US010494214B2

(12) United States Patent
Jensen et al.

(10) Patent No.: US 10,494,214 B2
(45) Date of Patent: Dec. 3, 2019

(54) WIND-UP APPARATUS FOR A WEB MATERIAL

(71) Applicant: Roll-O-Matic A/S, Vissenbjerg (DK)

(72) Inventors: John Buk Jensen, Vissenbjerg (DK); Mads Sandahl Christensen, Vissenbjerg (DK); Jens Peder Rasmussen, Vissenbjerg (DK)

(73) Assignee: Jensen Denmark A/S, Ronne (DK)

( * ) Notice: Subject to any disclaimer, the term of this patent is extended or adjusted under 35 U.S.C. 154(b) by 104 days.

(21) Appl. No.: 15/560,114

(22) PCT Filed: Mar. 22, 2016

(86) PCT No.: PCT/EP2016/056231
§ 371 (c)(1),
(2) Date: Sep. 20, 2017

(87) PCT Pub. No.: WO2016/150946
PCT Pub. Date: Sep. 29, 2016

(65) Prior Publication Data

US 2018/0099832 A1 Apr. 12, 2018

(30) Foreign Application Priority Data

Mar. 23, 2015 (DK) ..... 2015 70165

(51) Int. Cl.
*B65H 18/10* (2006.01)
*B65H 19/30* (2006.01)
*B65H 18/02* (2006.01)

(52) U.S. Cl.
CPC ..... *B65H 18/10* (2013.01); *B65H 18/021* (2013.01); *B65H 19/30* (2013.01);
(Continued)

(58) Field of Classification Search
CPC ..... B65H 18/10; B65H 18/021; B65H 19/30; B65H 2408/231; B65H 2406/33
See application file for complete search history.

(56) References Cited

U.S. PATENT DOCUMENTS 3,718,302 A * 2/1973 Mount ..... B65H 18/106 242/533.3
4,030,681 A 6/1977 Schott, Jr.
(Continued)

FOREIGN PATENT DOCUMENTS

CN 202864519 U 4/2013
DE 8804614 U1 5/1988
(Continued)

OTHER PUBLICATIONS

Danish Search Report in Application No. PA 2015 70165 dated Oct. 23, 2015.
(Continued)

*Primary Examiner* — Sang K Kim
(74) *Attorney, Agent, or Firm* — McDermott Will & Emery LLP

(57) ABSTRACT

The invention relates to a roll making apparatus comprising spindles optionally having apertures for pressurized air and/or for applying a vacuum, the spindles being movable between a retracted position and an extended position, a roll engaging face configured to engage a roll carried by a spindle, upon the spindle carrying said roll moving to said retracted position, to move the roll relative to the spindle.

32 Claims, 9 Drawing Sheets

(52) U.S. Cl.
CPC ..... *B65H 2301/4139* (2013.01); *B65H 2301/41354* (2013.01); *B65H 2301/418526* (2013.01); *B65H 2406/10* (2013.01); *B65H 2406/33* (2013.01); *B65H 2408/231* (2013.01); *B65H 2701/191* (2013.01)

(56) References Cited

U.S. PATENT DOCUMENTS

| | | | | |
|---|---|---|---|---|
| 4,682,929 | A | 7/1987 | Kataoka | |
| 4,972,745 | A | 11/1990 | Bruder et al. | |
| 5,453,070 | A * | 9/1995 | Moody | B26D 3/164 493/288 |
| 5,588,644 | A | 12/1996 | Lotto et al. | |
| 6,142,407 | A * | 11/2000 | McNeil | B65H 18/021 242/533.6 |
| 6,425,547 | B1 * | 7/2002 | Singh | B65H 18/021 242/527 |
| 2003/0080234 | A1 * | 5/2003 | Baggot | B65H 18/10 242/532.3 |
| 2005/0211818 | A1 | 9/2005 | Fiedler | |
| 2010/0243789 | A1 | 9/2010 | Acciari | |

FOREIGN PATENT DOCUMENTS

| | | | |
|---|---|---|---|
| DE | 19814906 | A1 | 10/1999 |
| EP | 0139272 | A2 | 5/1985 |
| EP | 0810172 | A2 | 12/1997 |
| EP | 943569 | A2 | 9/1999 |
| EP | 1306332 | A2 | 5/2003 |
| EP | 2711320 | A1 | 3/2014 |
| JP | H02-169453 | A | 6/1990 |
| WO | 2009/035329 | A2 | 3/2009 |
| WO | 2012/046151 | A1 | 4/2012 |

OTHER PUBLICATIONS

PCT International Preliminary Report on Patentability in International Application No. PCT/EP2016/056231 dated Sep. 26, 2017.

* cited by examiner

WIND-UP APPARATUS FOR A WEB MATERIAL

CROSS REFERENCE

This application is the U.S. National Phase under 35 U.S.C. § 371 of International Application No. PCT/EP2016/056231, filed on Mar. 22, 2016, which claims the benefit of Denmark Application No. PA 2015-70165, filed on Mar. 23, 2015, the entire contents are hereby incorporated by reference.

FIELD OF THE INVENTION

The present invention relates to an apparatus suitable for the production on the basis of a primary web of rolls, coreless or with a core, comprising a plurality of bags or the like items, which bags may, as the case may be, be presented to the end-user in an individualized and interleaved form.

BACKGROUND OF THE INVENTION

Most usually, roils of plastic bags are wound into a roll. The type of bags most typically found on a roll, in particular a coreless roll, are bags known as freezing bags, trash bags or garbage bags.

It is known to provide a windup apparatus wherein a turret style winder is used to make such rolls of bags. The turret has a plurality of spindles together with means for indexing individual spindles into the path of the advancing stream of overlapped or interleaved bags, upon completion of each roll. Additionally, the spindles may be provided with apertures through which vacuum is drawn for gripping each leading edge of each first bag, upon indexing of individual spindles into the path of the advancing overlapped bags, together with means for reversing the vacuum into positive air pressure, upon indexing of individual spindles with completed rolls out of the path of the advancing interleaved bags, as well as means for pushing a completed roll off a pressurized spindle. European patent 810 172 discloses such an apparatus wherein the spindle carrying the completed roll is reversed for a short time to facilitate removal.

BRIEF SUMMARY OF THE INVENTION

The object of the present invention is to provide an improved apparatus of the type mentioned above, which allows for high-speed manufacturing of rolls and which may be easily configured to operate on two separate streams of bags to be wound up, with a low requirement for space for the installation of the apparatus. For this the invention involves an apparatus according to claim 1 allowing a step of retracting, relative to a spindle support carrying the spindles, the spindles into a retracted position for sliding the finished rolls off the spindles. This eliminates the need for machine parts for pushing off a finished roll to be arranged in the path in which the spindles move for indexing.

Where core-less roils are made the spindles may be provided with apertures for supplying pressurized air to allow a sliding off of the rolls without distorting the shape of the rolls. Where rolls with cylindrical cores are made pressurized air may not need to be supplied; however, the same apertures may conveniently be used for applying a vacuum maintaining the cores against rotation relative to the spindles.

Preferably, a further or second spindle support is used for supporting the spindles in their extended position and located opposite the spindle support from which the spindles are extended. This is particularly preferred where the spindles are slim and thus prone to deformations.

The apparatus of the invention may in a highly interesting embodiment allow for an easy collection of finished rolls at one side of a machine adapted for processing two individual streams of primary web material. According to this embodiment two turrets, referred to in the following as "subsections", each having a first spindle support, are provided and arranged in such a manner that the spindles of one undergo the aforementioned retraction in a direction opposite the direction of retraction of the other, whereby finished rolls from either subsection may be discharged to a central area of the machine, onto or into a conveyor preferably being oriented to finally discharge all finished rolls to the aforementioned one side of the machine. This again makes it possible to present a machine having a relatively small width transverse to the direction along which the two primary webs are advanced, compared to a set-up involving two prior art machines having roll pushing-off means and located side-by-side.

An embodiment of the invention will now be described, by way of example only, with reference to the accompanying drawings, as follows:

FIGS. 1*a* and 1*b* are longitudinal perspective and schematic cross-sectional views of a machine 1 for processing a flat web and incorporating the apparatus of the present invention, in FIG. 1*b* shown with an optional wrapping device for the rolls.

FIG. 2 shows an end view of the machine of FIG. 1*a*, as seen to the left in FIG. 1*a*, with the end wall removed and in one operating state, FIGS. 3*a* and 3*b* show perspective views of the apparatus of the invention, with all other parts of the machine of FIG. 1*a* removed, and illustrating spindles in retracted and advanced positions, FIG. 4 is a view similar to FIG. 2 showing the apparatus in another operating state wherein a finished roll is leaving a spindle, FIGS. 5*a* and 5*b* are views similar to FIGS. 3*a* and 3*b*, showing a basic configuration of the apparatus of the invention, with some elements removed, and FIG. 5*c* is a similar view showing the drive, FIGS. 6*a* and 6*b* are views showing a spindle unit supported by a spindle support in extended and retracted position, respectively (cross-section), FIG. 7 is a view showing a portion of the machine as viewed towards a side, illustrating the discharge of finished rolls, and FIGS. 8*a* and 8*b* show details relating to air nozzles for initiating roll-up and brushes for guiding the web around a spindle.

The shown machine 1 includes as a machine part an apparatus according to the present invention, referenced generally by numeral 20 (shown only in part in FIG. 1*a*) and highly suitable for making careless rolls 5 comprising a number of the aforementioned individualized sections of the web. Alternatively, the rolls 5 may comprise an integral length of the web presenting cross-wise perforations, requiring an end-user to do the individualization himself, this length of the web having been separated from adjoining lengths of the web by the aforementioned separator mechanism. It will be understood that the number of plastic bags/sections rolled up is determined by the length of the web selected as basis for making the individual rolls 5, and this length may typically be chosen within a certain range according to the design of the machine 1 and/or apparatus 20, such as in the order of 30 cm with the rolls 5 having a diameter in the order of 3 cm-15 cm, by way of example.

As mentioned, the integral lengths of the web and, where applicable also individualized short sections thereof, are separated from each other using a separator mechanism incorporated in the machine 1. One separator mechanism for performing such a separation is shown by way of example in U.S. Pat. No. 5,588,644; this known machine also performs an interleaving procedure wherein individualized sections separated from each other by the separator mechanism are arranged in a partially overlapping, shingle-like manner, for subsequent rolling-up. The apparatus of the present invention may find use in connection with a variety of such separator mechanisms.

Integration of the present apparatus 20 in a machine 1 where the separation of lengths of the web from each other is carried out, preferably with an additional individualization and interleaving of sections of each such length of the web, is preferred as this may lead to significant benefits as regards machine manufacturing costs, easy maintenance and low installation space requirements.

Figure 1A:
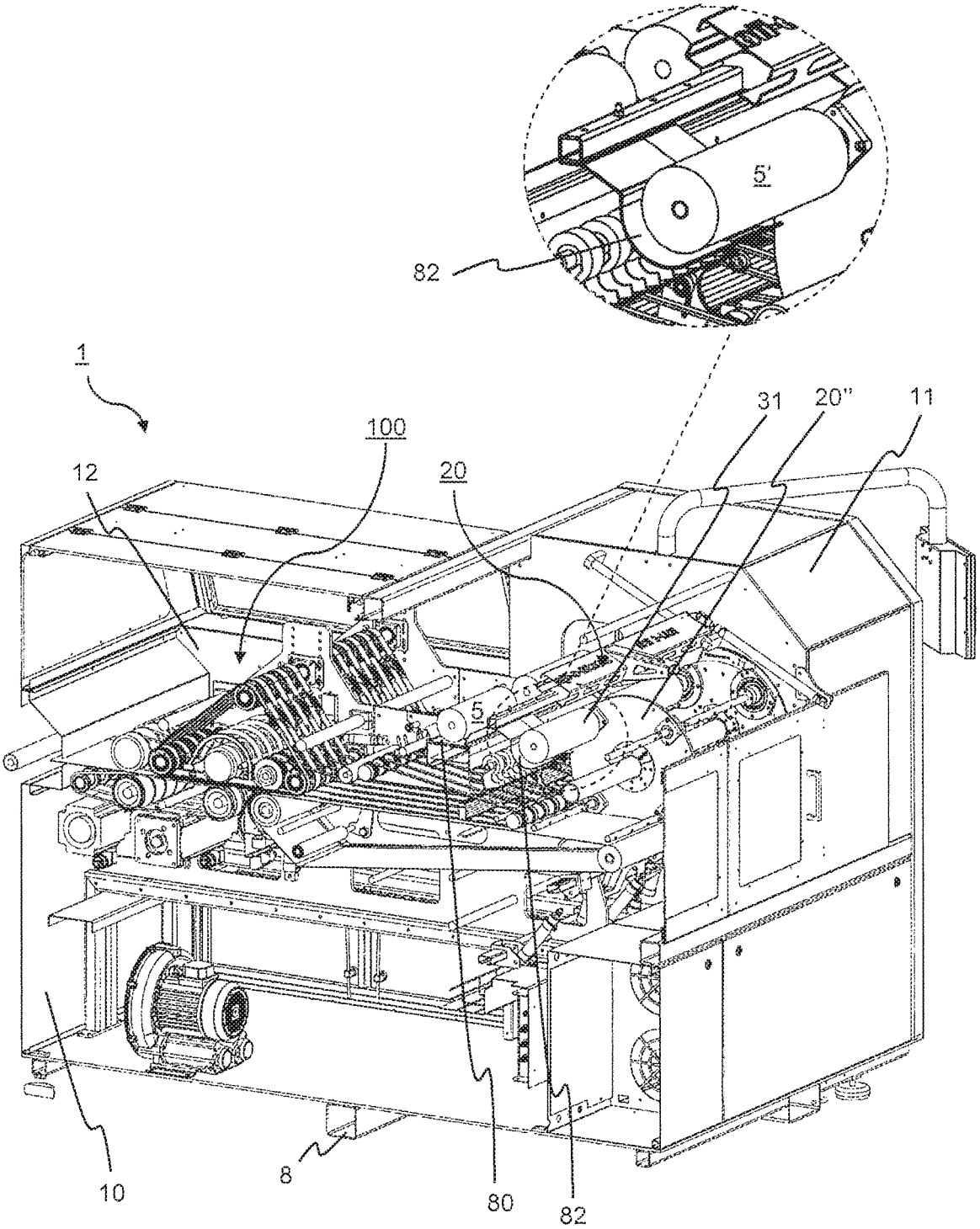
FIGS. 1*a* and 1*b* show a longitudinal perspective and schematic cross-sectional view of a machine 1 for processing a flat web (not shown) of a plastic foil being fed into the machine 1 at the part of the machine shown to the left in FIGS. 1*a* and 1*b*. The web being processed may by way of example have a width in the order of 10 cm-40 cm, and is preferably based on a primary web of a foil which in a previous step (not shown) has been folded lengthwise, welded cross-wise and provided with cross-wise perforations for easy cross-wise separation of the web into individual short sections. These individual sections may by way of example have an extension along the web in the order of 10 cm-100 cm and may define individual plastic bags. The individualization, or separation, of the sections from each other, may be done by an end-user or by a dedicated separator mechanism part of the machine 1.
Figure 1B:
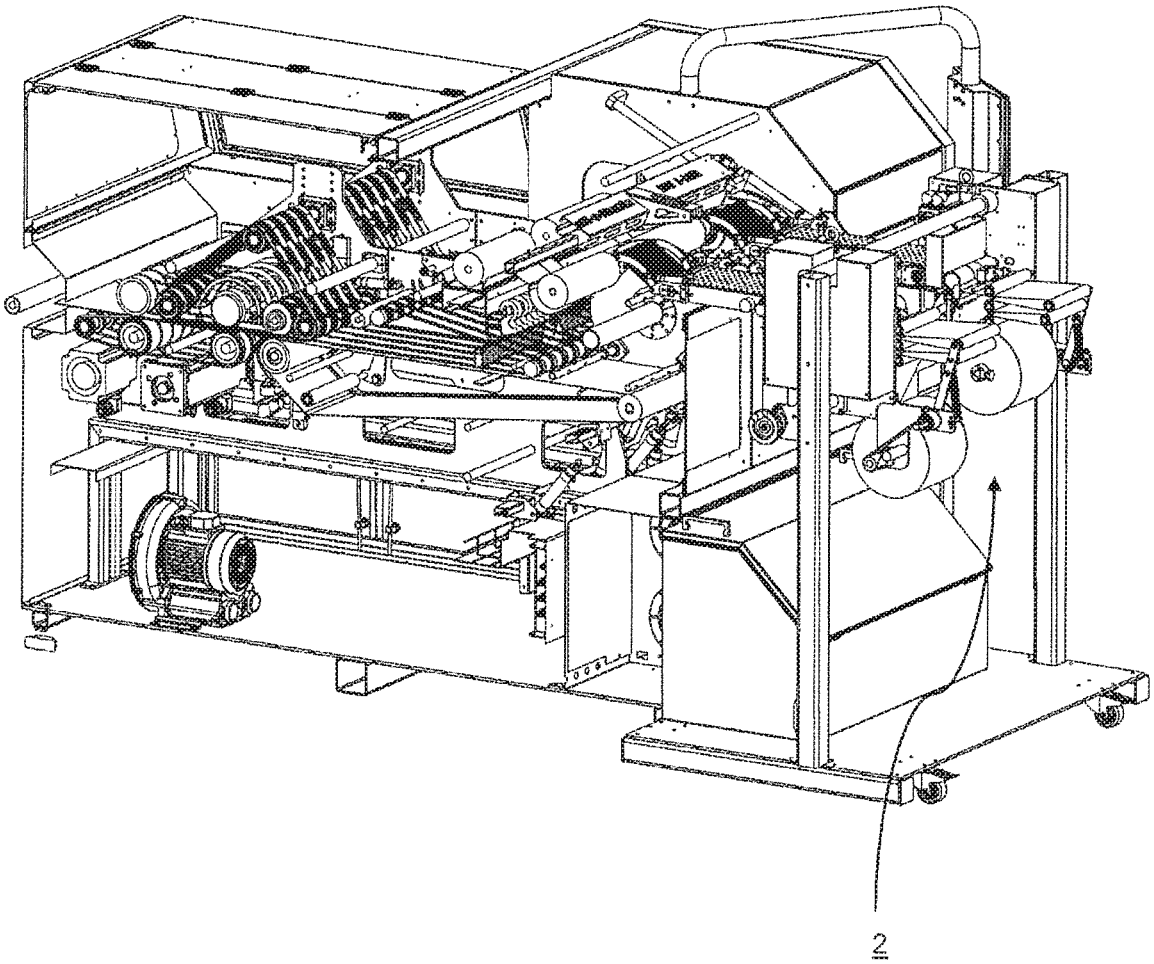

As will be understood from the following the apparatus 20 is highly suitable for performing a winding-up procedure for making core-less rolls 5, such as on the basis of interleaved, and optionally statically charged, short sections of a primary web, such as sections defining bags, being presented to the apparatus 20 directly from the upstream located separator mechanism which also may performs an interleaving. This separator mechanism is in the drawings referred to by reference numeral 100; FIGS. 1*a* and 1*b* shows the separator mechanism 100 acting also to perform an interleaving.

Referring to FIG. 1*a*, the initial processing of the web, including such steps as the separating of the web into sections and interleaving those sections, takes place in the separator mechanism 100 in the left side half of the machine 1 while the apparatus 20 according to the present invention for making the rolls 5 is incorporated in the right side half of the machine 1. In this arrangement, the left side half of the machine 1 has the primary web infeed section while the right side half has a section with a conveyor 80 for discharge of completed rolls 5 and located between the separator mechanism 100 and the apparatus 20.

The machine 1 of FIG. 1*a* highly conveniently allows for processing of two parallel streams of a primary web using a separator mechanism 100 acting on both streams; the view of FIG. 1*a* illustrates one half of the machine 1 with most of the elements required for the processing of both of the two parallel primary streams, as well as for winding up of interleaved sections for making rolls 5 from those streams, using the present apparatus 20. Two subsections 20', 20" of the apparatus 20 preferably work in tandem or synchronized.

The machine 1 generally includes a frame 8 and a housing 10 having an end wall 11 delimiting the shown right side half of the machine to the right, as well as two opposite longitudinal sides 12 extending parallel with the aforementioned primary streams, between left and right in FIG. 1*a*. A wrapping device 2 shown in FIG. 1*b* only is preferably located next to the machine 1, and operates to provide a wrapping around the completed rails 5 before they are discharged.

Figure 2:
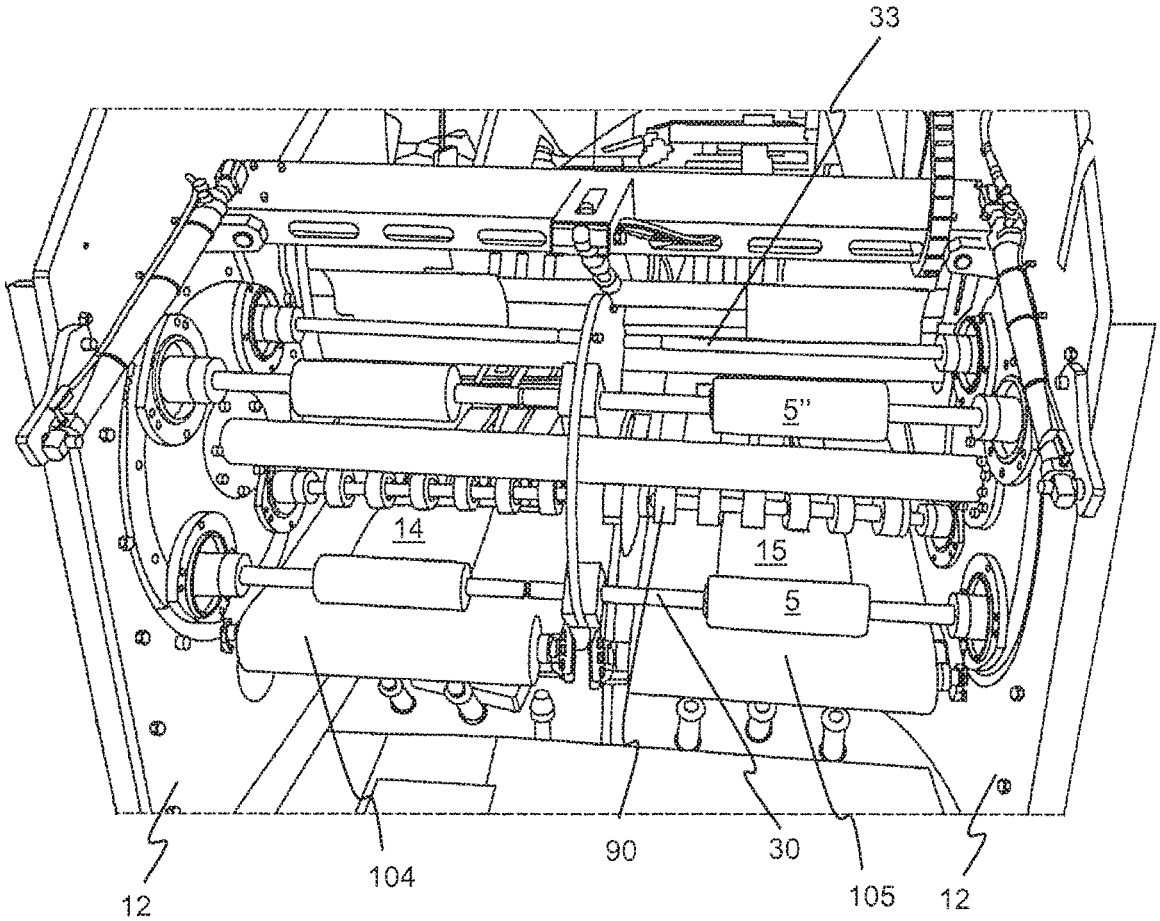

FIG. 2 shows the right side half of the machine 1 as viewed from the outside of the housing 10 to the left in FIG. 1*a*, with the end wall 11 removed, FIG. 2 also shows by numerals 14 and 15 each of the two primary streams after having been processed at the separator mechanism 100, here in the form of interleaved sections of the primary web, being supported by a respective conveyor belt 104, 105. The two parallel conveyor belts 104, 105 extend into the roll-making apparatus 20 from the separator mechanism 100, with the downstream end of the conveyor belts 104, 105 being visible in FIG. 2.

As shown in FIG. 2 and in FIGS. 3*a*/3*b* the roll-making apparatus 20 of an embodiment of the invention comprises two subsections 20', 20" in extension of each other, preferably working in tandem/being synchronized as explained further below, a central member being arranged between the two subsections 20', 20". The apparatus 20 of the shown embodiment generally includes a central axle 22 supported at each end by a respective one of the opposite sides 12 of the housing 10, and driven for rotation by a motor 23. The subsections 20', 20" each have a first spindle support 21', 21", shown here as being a respective disc-shaped element and connected for rotation with the axle 22, whereby stepwise rotation of the axle 22 brings about a corresponding indexing or rotation of the two subsections 20', 20". The central member defines for each subsection 20', 20" a second spindle support 25 which preferably rotates together with the first spindle supports 21', 21". Two individual such second spindle supports 25 arranged back-to-back may also be contemplated.

Figure 3A:
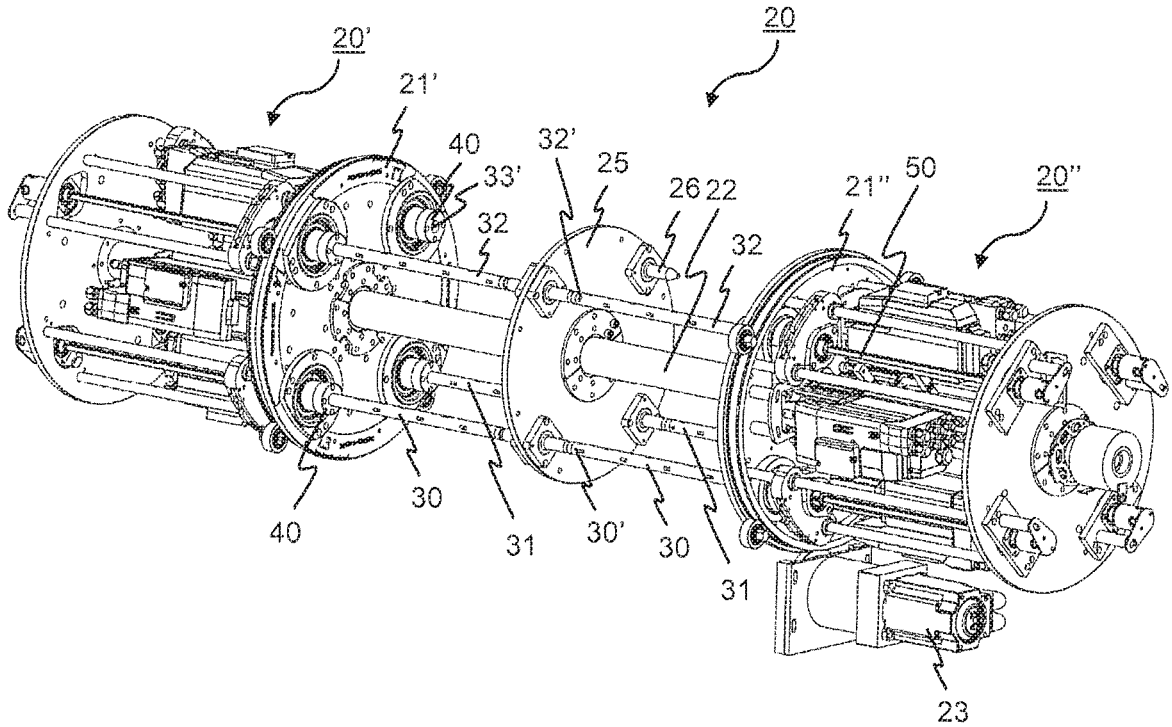
Figure 3B:
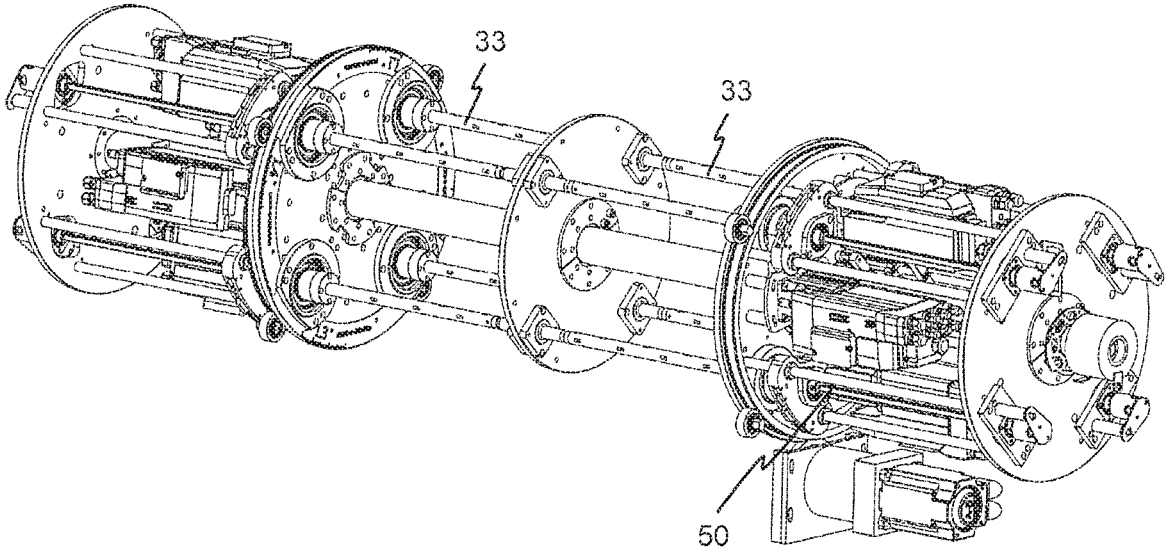

Each subsection 20', 20" includes a number of rotating and retractable elongated spindles carried by the respective first spindle support 21', 21", in the shown embodiment a total of four spindles 30, 31, 32, 33, of which one spindle 33 of each subsection 20', 20" is shown at the instant of being in a fully retracted position in FIG. 3*a* while being visible in the fully extended position thereof in FIG. 3*b*. FIGS. 1*a* and 2 show the spindles 30, 31, 32, 33 all being in the extended configuration shown in FIG. 3*b*. By "retraction" in the present context is meant that a distal end 30', 31', 32', 33' of each spindle 30, 31, 32, 33 becomes located closer to its supporting first spindle support 21', 21", having been moved away from the opposite second spindle support 25. The distal end 33' of retracted spindle 33 is barely visible in FIG. 3*a*. Preferably, but not necessarily, the spindles are cylindrical, with a constant cross-section along a major part of their length onto which the web is rolled, or the spindles 30, 31, 32, 33 can be slightly conical/tapered.

Figure 4:
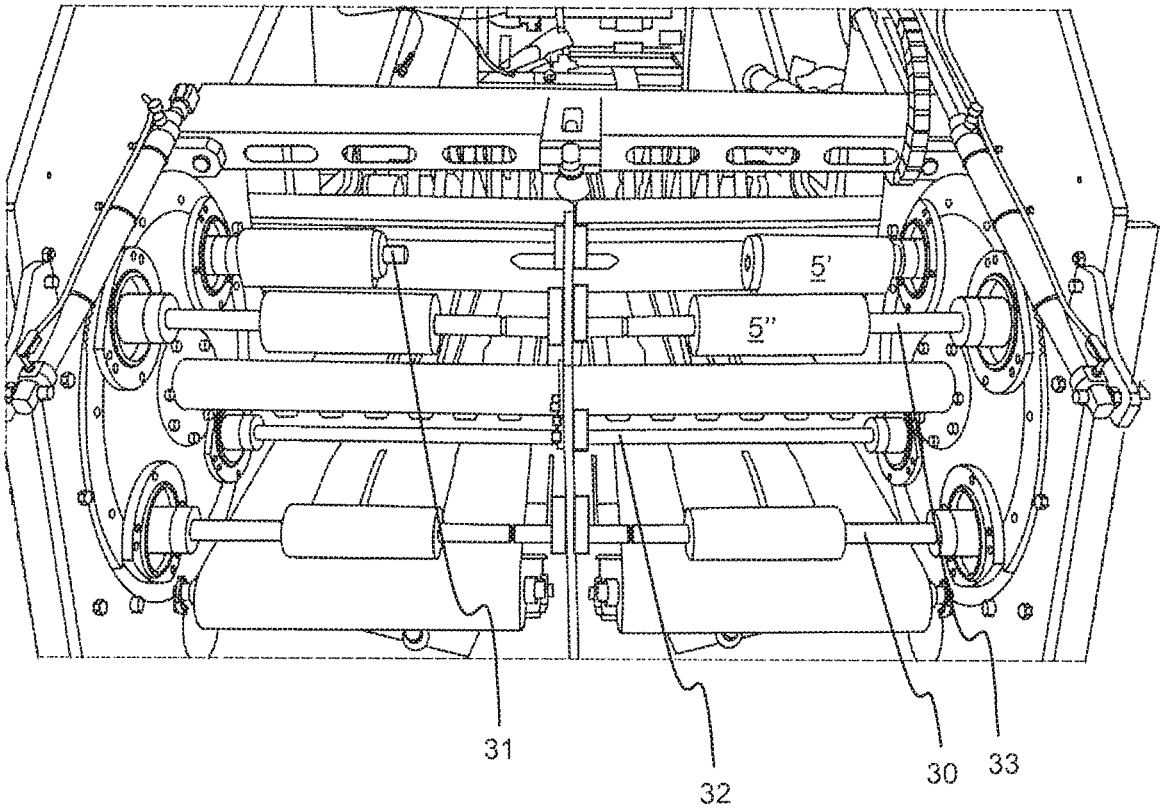

FIG. 4 shows three of the four spindles in the extended position also shown in FIG. 3*a*; a fourth spindle (not visible) within a finished roll 5' is in the process of moving towards the fully retracted position shown in FIG. 3*a* but still supports the roller 5' thereon, see also the enlarged section shown in FIG. 1*a*. In the extended position the distal end 30', 31', 32', 33' of each spindle is received by a bearing 26 mounted to the second spindle support 25 and having a shape complementary to the shape of the distal end, such as the shown tapering complementary to a conical recess formed at the distal end of the spindles. This support at the distal end 30', 31', 32', 33' of the spindles 30, 31, 32, 33 allows for the use of spindles 30, 31, 32, 33 having a relatively small diameter, and is important to prevent or limit sideways deflection of the spindles were they otherwise unsupported at their ends, which deflection in particular may pose problems when winding up on very small diameter spindles is carried out.

As explained, the parallel spindles 30, 31, 32, 33 of each subsection 20', 20" are supported on the one hand by the first spindle support 21, and are normally located at the same distance from the axis around which the spindle supports 20', 20" rotate. The spindles 30, 31, 32, 33 are driven to rotate relative to their first spindle support 21", preferably by being each coupled to a respective servomotor M mounted onto the first spindle support 21" and for individual controlling of the speed of rotation of each spindle 30, 31, 32, 33. The spindles, and their mounting to the spindle support 21, will be discussed in further details later below.

As the subsections 20', 20" are rotated or indexed stepwise so will each spindle 30, 31, 32, 33 consecutively be indexed or aligned stepwise with one lower position at the downstream end of the conveyor belts 104, 105 shown in FIG. 2, and then with another upper position closer to a common, transverse discharge conveyor 80, such as a conveyor belt or conveyor chute, see FIG. 1*a*. Having subsections 20', 20" with more than two spindles 30, 31, 32, 33 each allows for a buffer—or alternatively for the implementation of an extra work station wherein finished rolls 5", each remaining on a corresponding spindle 30 as shown in FIG. 4, are being provided with a wrapping by the wrapping device 2 shown in FIG. 1*b*, such as by being slowly rotated by the supporting spindle 30 whilst receiving an enclosing band which may be provided with glue.

As a spindle 32 carrying a finished roll 5" moves to the position shown in FIG. 2 by rotation of the axle 22, another spindle 30, in high speed rotation and being in the process of winding up a roll 5, moves to the position shown in FIG. 2 at the downstream end of the conveyor belts 104, 105, for continued winding-up of that roll 5. As seen in FIG. 4, another spindle 31 is now in position for discharge of a finished roller 5' to the transverse conveyor 80 while yet another upstream spindle 32, ready for use for winding up a new roll, is in a position slightly upstream the feed conveyor 104, 105, slightly above a portion of the web currently being wound up at the downstream end of the conveyor 104, 105 by the spindle 30. At the instant the trailing end of the length of the web material currently being wound up passes below this upstream spindle 32 an actuator located below the conveyor belts 104, 105 acts to raise the conveyor belts 104, 105 locally against this upstream spindle 32, such that the lead end of the subsequent length of the web material is presented to the upstream spindle 32, now at high speed rotation driven by its motor M, for initiating winding up of this subsequent length of the web material, as explained below. It is noted that the conveyor belts 104, 105 are mounted to accommodate for the increasing diameter of the roll 5 being wound up by the spindle 30 in the position shown in FIG. 4, preferably by allowing a vertical movement thereof to and from the downstream spindle 30.

FIG. 2 shows the position of each of the subsections 20', 20" wherein for each subsection winding-up of one roll 5 is in the process of being completed while a finished roll 5' has now been discharged from the machine 1, the spindle 33 nearest the transverse conveyor 30 having been returned to the extended position shown also in FIG. 3*b*.

FIG. 4 on the other hand shows the apparatus 20 at a point where a finished roll 5' of wound-up interleaved section of the primary web is being transferred from the spindle 31 to the transverse conveyor belt 80 seen best in FIG. 1, by means of a supporting pivotable tray 82, again seen best in the enlarged view in FIG. 1*a*; alternatively, a gripping device gripping around the roll 5' may be used. A this time, the spindle 31 previously carrying the finished roll 5' has been fully retracted to the position shown in FIG. 3*a*, with an engagement face 40 on the first spindle support 20" pressing against the end of the roll 5' as the spindle 31 is moved to the retracted position. As the spindle is retracted pressurized air exits apertures 60 formed in the spindle 33 to slightly expand the roll 5' from within, thereby ensuring that the roll 5' to a high degree maintains its shape as slides off the spindle 31. The transverse conveyor belt 80 preferably extends between the two opposite sides 12 of the machine 1, to receive rolls 5' transferred from each subsection 20', 20" by a respective pivotable tray 82 or other transfer device; the shown tray 82 has a pivot axle located out of the path of the spindles 30, 31, 32, 33 and allows the finished rolls 5' to fall by gravity onto the conveyor 80 after having turned to an upright position from the supporting horizontal position shown in FIG. 1*a*. In this way, finished rolls 5' may be discharged from the machine 1 at only one side 12 thereof, by the conveyor 80.

Figure 5A:
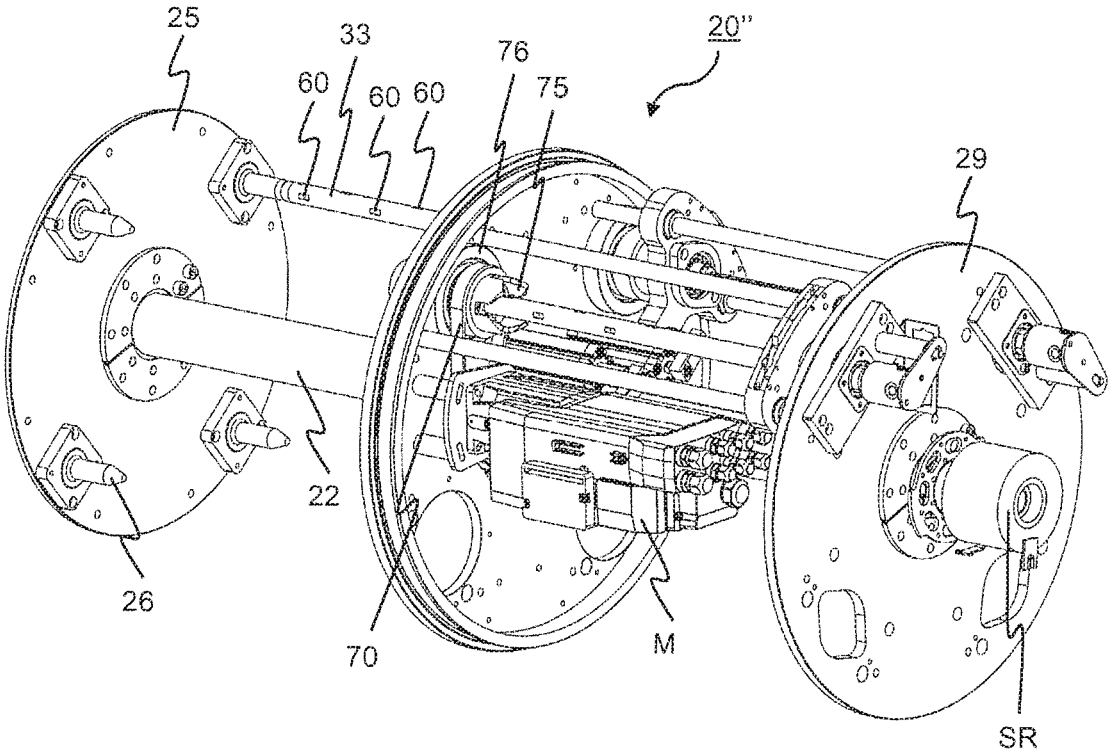
Figure 5B:
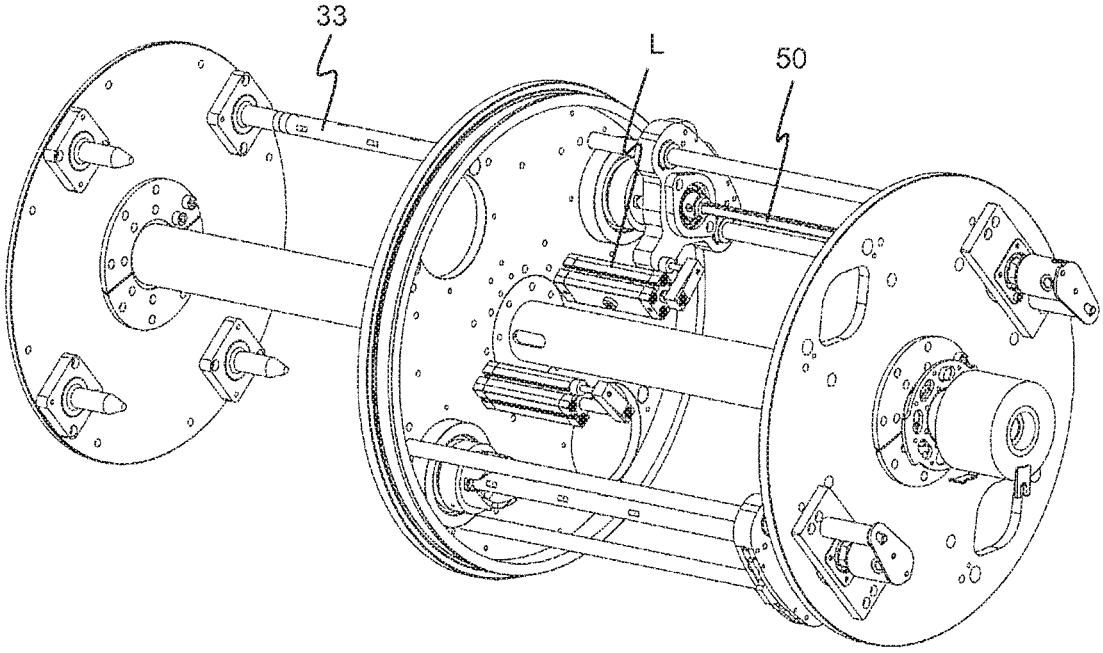
Figure 6A:
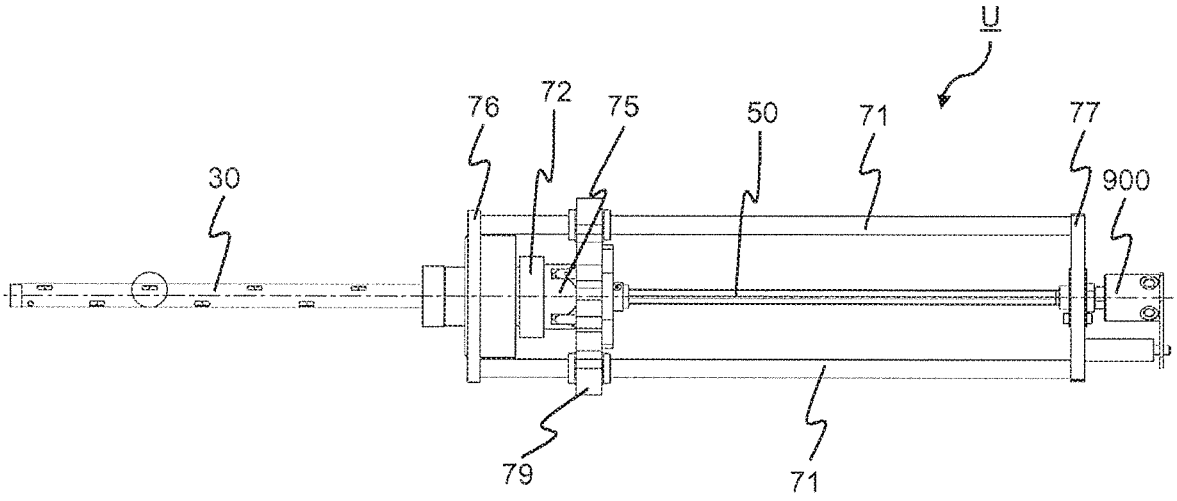
Figure 6B:
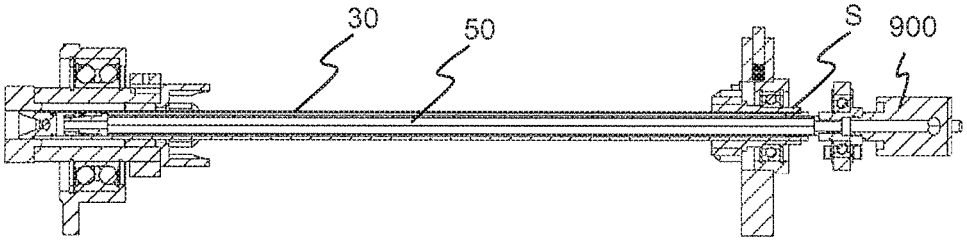

For simplicity, one subsection 20" of the two subsections will now be described in further details with reference to FIGS. 5*a* and 5*b*; yet further details with respect to the spindles are shown in FIGS. 6*a* and 6*b*; it should be understood that the same details are found in the other subsection 20'.

Turning to FIG. 5*a*, for simplicity two of the spindles shown by numerals 30 and 31 in FIG. 3*a*, as well as driving elements for the retraction of those spindles, have been removed. In FIG. 5*b* ail but one spindle 33 have been removed.

The preferred embodiment utilizes spindles 30, 31, 32, 33 that are each along the length thereof provided with an array of the aforementioned apertures 60 connected to an interior passage through which a vacuum can be drawn and/or through which the aforementioned pressurized air may flow to exit the apertures 60. Before starting to wind up a coreless roll 5 thereon, an empty spindle such as spindle 32 shown in FIG. 4 will be indexed to a position above the stream of web in the process of being wound up downstream at spindle 30 located adjacent the downstream end of the feed conveyor 104, 105. Timed to coincide with the spindle 30 having almost finished roll 5, i.e. corresponding to the instant shown in FIGS. 2 and 4, brushes 90 and nozzles N are pivoted downwardly generally in front of spindle 32. When the free, leading edge of the length of the web material to be rolled up on the spindle 32 approaches the spindle 32 forwarded by conveyor 104, 105 vacuum is applied through the apertures 60 in the rotating spindle 32; by the action of a burst of air from the air nozzles N, and guided by the rotating brushes 90, the aforementioned leading edge will wrap around the spindle 32 while the trailing edge of the roll 5 on spindle 30 is wound up on the spindle 30, as will be described in details with reference to FIGS. 8*a* and 8*b*.

Figure 8A:
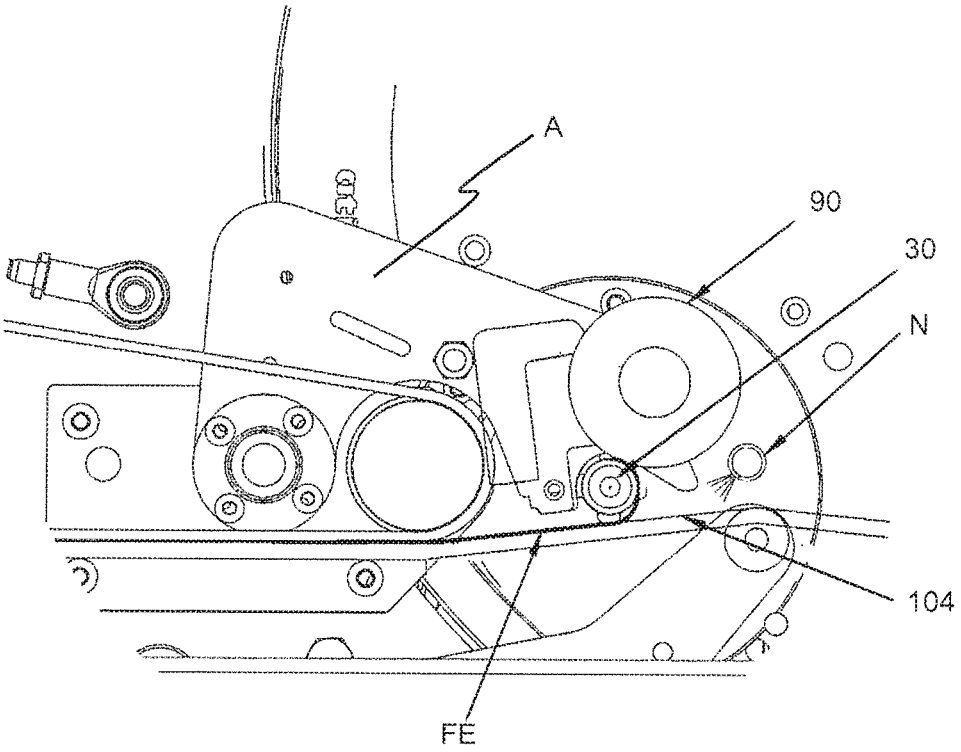
Figure 8B:
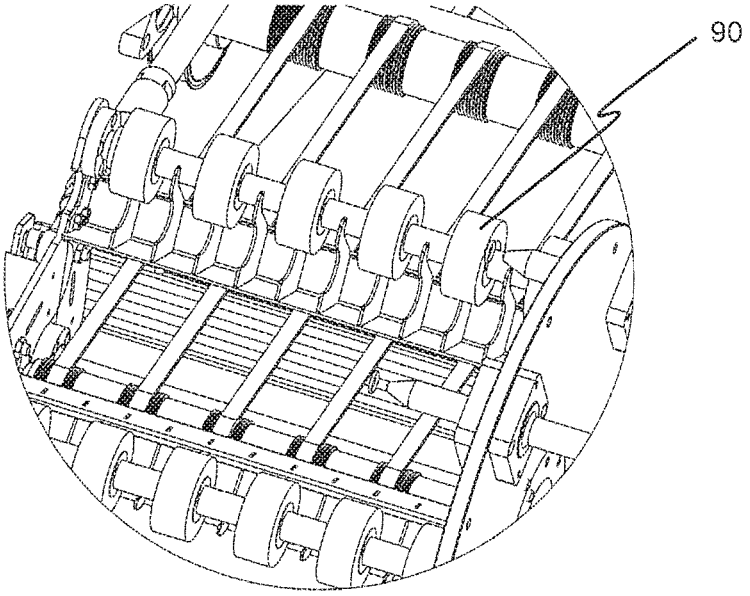

FIGS. 8*a* and 8*b* are views showing an arrangement of the aforementioned brushes 90 acting to guide the leading edge FE around the spindle 30, winding-up having been initiated by a burst of air from a set of nozzles N applying air against the leading free edge FE of the web, while vacuum is also being applied through apertures 60 in the spindle 30. The nozzles N and brushes 90 are carried by a pneumatically driven or motor driven arm A allowing for the downward pivotal movement thereof into correct position of the nozzles N next to and in front of the spindle 30 and with the brushes 90 having bristle tips touching the spindle 30 at a position above the conveyor belt 104, preferably within a first quadrant (range between vertical and +90°) of the periphery of the spindle 30. FIG. 8*b* is a perspective schematic view with some elements removed and showing the arm A in a raised position with a row of brushes 90.

As will be understood the nozzles N act to help this first web section get started on the rotating spindle 30 while the brushes 90 have a guiding function. The supporting conveyor 105 may also preferably be raised slightly to serve the new bag to the spindle 32. Once the first bag/section (and possibly more than one bag) is secure on the spindle 32 the subsection 20" will index or rotate to the position shown in FIG. 4 and the roll 5" will then finish winding on the spindle now located at the downstream end of the conveyor 104, 105.

As seen in FIG. 5*b* the first spindle support 20" carries a plurality of individual air flow conduits 50, each being telescopically receivable by a respective spindle 30, 31, 32, 33 when the latter moves to the retracted position. The air flow conduits 50 are each being connected to a source of pressurized air and optionally and selectively also to vacuum.

When in the extended position each spindle 30, 31, 32, 33 is driven to rotation by its corresponding motor M supported by the rotating first spindle support 20", through a drive 70. This drive 70 may simply, as shown in FIG. 5*a*, be a toothed belt acting on a corresponding surface 72 of a rotating structure supported by the first spindle support 21" via bearings by a mount 76, see FIG. 6*a*.

FIG. 5*a* shows one spindle/air flow conduit unit U as shown in more details in FIG. 6*a* mounted i) onto the first spindle support 21" via the aforementioned mount 76, and ii) onto another, opposite supporting structure 29 of the subsection 20" via a further mount 77. A sled 79 is coupled to the proximal end of the rotating spindle 30 via bearings and runs on opposed guiding bars 71; the sled 79 is driven for controlled movement along the length of the guiding bars 71 by a sled drive D (seen in FIG. 5*c*) fixed to the housing 10 of the machine 1 next to the roll-discharge position of the spindles, i.e. at the position P shown in FIG. 5*c*, to which position the spindles are brought by the rotating first spindle support 21". More specifically, on activation of the sled drive D by a controller, as will be the case when a finished roll 5 is to be released from a spindle, the sled drive D engages the sled 79 to move the spindle 30 to the retracted position, i.e. to the right in FIG. 6*a*, with the spindle 30 at the same time telescopically receiving the air flow conduit 50. This movement/retraction of the spindle 30 and the sled 79 by the sled drive D disengages the sled 79 from a clutch part 75 on the part having the surface 72, whereby the spindle 30 is no longer driven to rotation by the motor M. When the sled drive D is activated to reverse the aforementioned movement a lock L engages the sled 79 and clutch part 75 is reengaged as the spindle 30 reaches its fully advanced position, in order to maintain by the lock L this advanced position when the first spindle support 21" is then rotated by axle 22 and the spindles rotated by their motors M.

The air flow conduit 50 is preferably formed as a straight tube supported by the further mount 77 at one end and within the spindle 30 at its other end; preferably, the air flow conduits 50 have a non-circular, such as square, outer contour received by a correspondingly shaped structure S inside the proximal end of the cylindrical spindles 30, so that there is no relative rotational movement between the spindles and their corresponding air flow conduits.

The described structure allows for the use of a highly simple sliding air seal between the spindle 30 and the corresponding air flow conduit 50 since there is no relative rotational movement; the air seal prevents pressure loss through apertures 60 in the spindle 30 located near the proximal end of the spindle 30. Such a loss would be undesirable since a high air pressure must still be maintained in the distal portion of the spindles on which the finished roll still remains until the spindle 30 is fully retracted; absent such a high pressure the roll cannot be discharged without destroying its cylindrical form. A connection 900 at the end of the air flow conduit closest to the further mount 77 connect the inside of the air flow conduit 50 and, hence, the spindle 30 with a source of pressurized air/vacuum.

Figure 7:
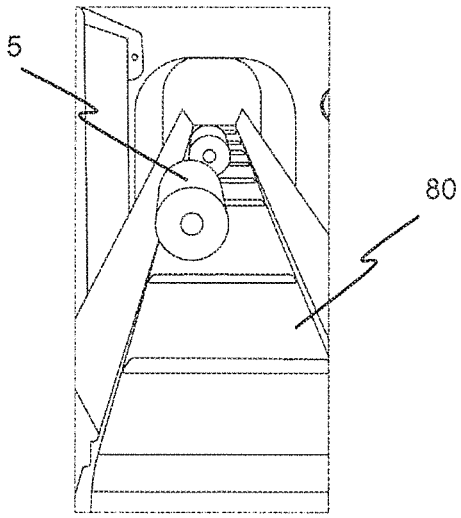

FIG. 7 is a view showing a portion of the machine 1 as viewed towards side 12 and showing a side opening for discharging finished rolls 5 advanced by the conveyor 80.

While rotation of the second spindle support 25 together with the first spindle support 21" is preferred, a circular track providing locally the aforementioned bearings 26 may be provided in a stationary second spindle support 25, for supporting the distal ends of the spindles 30, 31, 32, 33 and allowing the spindles to change position as the first spindle support 21', 21" is rotated. Such a circular track may have local bearing 26, such as in the form of notches or recesses complementary with the distal end of the spindles, and into which notches the distal ends enter on being rotated by the first spindle support 21' to eg. the winding positions shown in FIG. 4.

It is noted that the present invention also relates to a method of operating the disclosed apparatus 20, wherein discharge of the finished roils take place by sliding the rolls off the spindles through the step of retracting the spindles while at the same time withholding the rolls by providing an engagement surface acting against the end face of the rolls.

Conveniently, the aforementioned apertures 60 have a transverse dimension increasing towards the outer surface of the spindles 30, 31, 32, 33, for providing an increased contact area with the web/core on the spindles.

While not shown herein, the invention is also suitable for making rolls with a separate core applied to a spindle 33 in, by way of example, the position shown in FIG. 2 after removal after a finished roll. The core is preferably held in position on the spindle 30 against relative rotation by a vacuum applied through the apertures 60, and winding up then is assisted by the aforementioned brushes 90 and nozzles N.

Figure 5C:
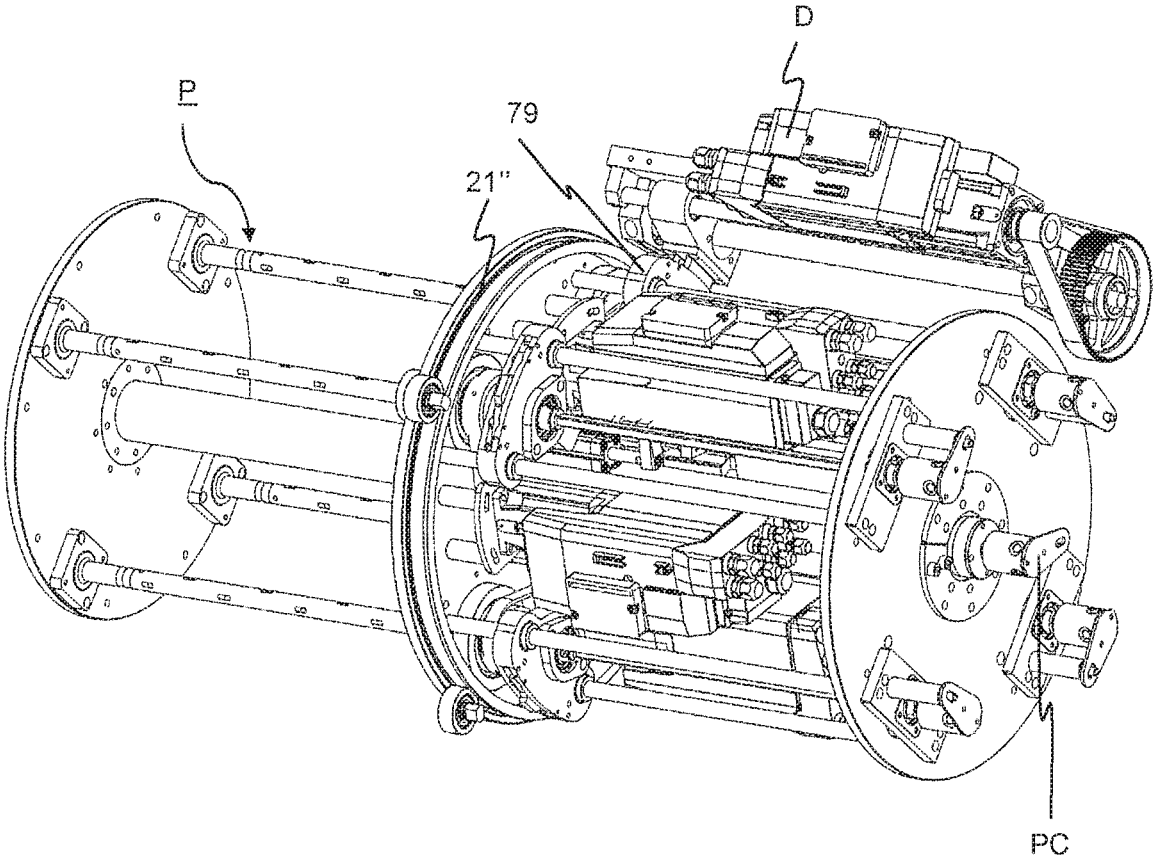

It is noted that controlling of the motors M with build-in servo controller may be by bus signals with digitally coded signals which, together with the driving power, may be transferred from stationary parts of the apparatus to the rotating subsections 20', 20" through a slip ring SR/rotating electrical connectors, part of which is seen mounted to the right in FIG. 5*a*, on the supporting structure 29 of the subsection 20". A rotating pneumatic coupling PC supplying pressurized air/vacuum to the individual connections 900 (see FIG. 6*b*) is shown in FIG. 5*c*, prior to mounting of the slip ring SR. Using motors M with build-in servo controllers allows for a reduction in the number of electrical connections required for the slip ring. Vacuum may alternatively or additionally be generated by means of an ejector setting-up the required vacuum through supply of pressurized air.

The invention claimed is:

1. A roll making apparatus comprising:

a frame comprising a feed conveyor for advancing a length of a web to be wound-up as a roll;

a subsection comprising a first spindle support mounted to rotate and carry a plurality of parallel elongated spindles, each spindle mounted to rotate relative to said first spindle support, for winding up thereon said length of said web, said rotation of said first spindle support and of said spindles being about a respective axis perpendicular to said advancing length of the web, said spindles comprising a respective distal end and being movable between a retracted position, wherein said respective distal end is closer to said first spindle support, and an extended position;

a face disposed on said first spindle support, the face configured to engage said roll carried by a spindle of said plurality of parallel elongated spindles, upon said spindle carrying said roll moving to said retracted position, to move said roll relative to said spindle; and a conveying device for conveying rolls discharged from said spindle upon said spindles moving to said retracted position, said spindles having apertures along a length thereof for one of applying pressurized air, applying a vacuum, and interchangeably applying pressurized air and applying the vacuum.

2. The apparatus of claim 1, further comprising a second spindle support located opposite said first spindle support, said second spindle support including bearings configured to support said distal ends of said rotating spindles when in said extended position.

3. The apparatus according to claim 1, wherein said spindles each having a proximal end connected to an air flow conduit for one of said pressurized air and said vacuum.

4. The apparatus according claim 1, wherein said first spindle support supporting air flow conduits telescopically receivable by said spindles when moving to said retracted position, said air flow conduits being connected to a source of said pressurized air, said spindles and said air flow conduits preferably being air sealed in relation to each other.

5. The apparatus according to claim 1, wherein said apertures of said spindles being sequentially closed on said spindle moving to said retracted position.

6. The apparatus according claim 1, further comprising a rotatable axle carrying said first spindle support, extending perpendicular to said feed conveyor, a motor being configured for stepwise rotation of said first spindle support.

7. The apparatus according claim 1, including a transferring device movable to receive and to transfer said discharged rolls to said discharge conveyor.

8. The apparatus according to claim 1, wherein a speed of rotation of said spindles is individually controllable.

9. The apparatus according claim 8, wherein said subsection including a respective motor for rotation of a corresponding spindle, and including a drive for said moving between said retracted and extended position.

10. The apparatus according to claim 9, wherein said motors being supported by said first spindle support.

11. The apparatus according to claim 9, wherein said drive being fixed to a housing of said apparatus.

12. The apparatus according to claim 1, including two of said subsections, mounted such that the distal ends of said spindles of one of said two subsections move to said retracted position in a parallel opposite direction compared to the movement of the distal ends of said spindles of the other subsection.

13. The apparatus according to claim 12, wherein said two subsections being coupled to a common axle for rotation.

14. The apparatus according to claim 12, wherein said conveying device being common to said two subsections, at least a portion of said conveying device conveying said discharged rolls perpendicular to the direction of said advancing.

15. The apparatus according to claim 14, including a respective feed conveyor for each subsection.

16. The apparatus according to claim 1, including one or more brushes arranged to interact with said web to guide it around said spindles, and also including nozzles for providing an air-flow oriented towards a leading edge of said web for initiating folding thereof around said spindles.

17. A roll making apparatus comprising:

a frame comprising a feed conveyor for advancing interleaved sections of a length of a web to be wound-up as a roll;

a subsection comprising a first spindle support mounted to rotate and carry a plurality of parallel elongated spindles, each spindle mounted to rotate relative to said first spindle support, for winding up thereon said interleaved sections of said length of said web, said rotation of said first spindle support and of said spindles being about a respective axis perpendicular to said advancing said interleaved sections of said length of said web, said spindles comprising a respective distal end and being movable between a retracted position, wherein said respective distal end is closer to said first spindle support, and an extended position;

a face disposed on said first spindle support, the face configured to engage said roll carried by a spindle of said plurality of parallel elongated spindles, upon said spindle carrying said roll moving to said retracted position, to move said roll relative to said spindle; and a conveying device for conveying rolls discharged from said spindle upon said spindles moving to said retracted position, said spindles having apertures along a length thereof for one of applying pressurized air, applying a vacuum, and interchangeably applying pressurized air and applying the vacuum.

18. The apparatus of claim 17, further comprising a second spindle support located opposite said first spindle support, said second spindle support including bearings configured to support said distal ends of said rotating spindles when in said extended position.

19. The apparatus according to claim 17, wherein said spindles each having a proximal end connected to an air flow conduit for one of said pressurized air and said vacuum.

20. The apparatus according claim 17, wherein said first spindle support supporting air flow conduits telescopically receivable by said spindles when moving to said retracted position, said air flow conduits being connected to a source of said pressurized air, said spindles and said air flow conduits preferably being air sealed in relation to each other.

21. The apparatus according to claim 17, wherein said apertures of said spindles being sequentially closed on said spindle moving to said retracted position.

22. The apparatus according claim 17, further comprising a rotatable axle carrying said first spindle support, extending perpendicular to said feed conveyor, a motor being configured for stepwise rotation of said first spindle support.

23. The apparatus according claim 17, including a transferring device movable to receive and to transfer said discharged rolls to said discharge conveyor.

24. The apparatus according to claim 17, wherein a speed of rotation of said spindles is individually controllable.

25. The apparatus according claim 24, wherein said subsection including a respective motor for rotation of a corresponding spindle, and including a drive for said moving between said retracted and extended position.

26. The apparatus according to claim 25, wherein said motors being supported by said first spindle support.

27. The apparatus according to claim 25, wherein said drive being fixed to a housing of said apparatus.

28. The apparatus according to claim 17, including two of said subsections, mounted such that the distal ends of said spindles of one of said two subsections move to said retracted position in a parallel opposite direction compared to the movement of the distal ends of said spindles of the other subsection.

29. The apparatus according to claim 28, wherein said two subsections being coupled to a common axle for rotation.

30. The apparatus according to claim 28, wherein said conveying device being common to said two subsections, at least a portion of said conveying device conveying said discharged rolls perpendicular to the direction of said advancing.

31. The apparatus according to claim 30, including a respective feed conveyor for each subsection.

32. The apparatus according to claim 17, including one or more brushes arranged to interact with said web to guide it around said spindles, and also including nozzles for providing an air-flow oriented towards a leading edge of said web for initiating folding thereof around said spindles.

* * * * *